US010039428B2

(12) United States Patent
Newton et al.

(10) Patent No.: US 10,039,428 B2
(45) Date of Patent: Aug. 7, 2018

(54) UPRIGHT VACUUM CLEANER

(71) Applicant: Dyson Technology Limited, Wiltshire (GB)

(72) Inventors: David Christopher James Newton, Bristol (GB); Stephen Robert Dimbylow, Swindon (GB); Peter David Gammack, Gloucester (GB); Ian John Brough, Bristol (GB); Adam David Lambert, Swindon (GB); Simon Brian McNamee, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 15/246,169

(22) Filed: Aug. 24, 2016

(65) Prior Publication Data

US 2017/0055790 A1 Mar. 2, 2017

(30) Foreign Application Priority Data

Aug. 25, 2015 (GB) ..... 1515105.3

(51) Int. Cl.
*A47L 5/28* (2006.01)
*A47L 5/32* (2006.01)
(Continued)

(52) U.S. Cl.
CPC ..... *A47L 5/28* (2013.01); *A47L 5/225* (2013.01); *A47L 9/0036* (2013.01);
(Continued)

(58) Field of Classification Search
CPC . A47L 5/28; A47L 9/325; A47L 9/165; A47L 9/0045; A47L 5/225; A47L 9/1641;
(Continued)

(56) References Cited

U.S. PATENT DOCUMENTS 5,078,761 A 1/1992 Dyson
5,386,612 A 2/1995 Sham
(Continued)

FOREIGN PATENT DOCUMENTS

CN 1541605 11/2004
CN 1242720 2/2006
(Continued)

OTHER PUBLICATIONS

Search Report dated Jan. 22, 2016, directed to GB Application No. 1515105.3; 1 page.

*Primary Examiner* — David Redding
(74) *Attorney, Agent, or Firm* — Morrison & Foerster LLP

(57) ABSTRACT

An upright vacuum cleaner comprising a vac-motor for drawing dirty air in through a floor-engaging cleaner head on the vacuum cleaner, a separating apparatus for separating dirt from the dirty air, an elongate air duct for carrying air to or from the separating apparatus, and a suction wand which is stored on the vacuum cleaner and which can be connected to the separating apparatus via a hose as required to clean above the floor. The external surface of the air duct defines an elongate recess for receiving the stored suction wand such that the air duct partly surrounds the stored wand. This provides a compact configuration.

13 Claims, 6 Drawing Sheets

(51) Int. Cl.

| | |
|---|---|
| ***A47L 9/00*** | (2006.01) |
| ***A47L 9/16*** | (2006.01) |
| ***A47L 5/22*** | (2006.01) |
| ***A47L 9/32*** | (2006.01) |

(52) U.S. Cl.
CPC ..... *A47L 9/0045* (2013.01); *A47L 9/165* (2013.01); *A47L 9/1625* (2013.01); *A47L 9/1641* (2013.01); *A47L 9/1683* (2013.01); *A47L 9/325* (2013.01)

(58) Field of Classification Search
CPC .... A47L 9/1683; A47L 9/0036; A47L 9/1625; A47L 5/32
USPC ..... 15/335
See application file for complete search history.

(56) References Cited

U.S. PATENT DOCUMENTS

| | | | | |
|---|---|---|---|---|
| 8,601,641 | B2 | 12/2013 | Conrad | |
| 2003/0101535 | A1 | 6/2003 | Gammack et al. | |
| 2004/0194247 | A1 | 10/2004 | Macleod et al. | |
| 2007/0209334 | A1 | 9/2007 | Conrad | |
| 2016/0113454 | A1* | 4/2016 | Rukavina | A47L 5/225 15/335 |
| 2016/0157689 | A1* | 6/2016 | Muhlenkamp | A47L 5/225 134/21 |

FOREIGN PATENT DOCUMENTS

| | | |
|---|---|---|
| CN | 101073481 | 11/2007 |
| CN | 201167922 | 12/2008 |
| CN | 104161485 | 11/2014 |
| EP | 0 827 710 | 3/1998 |
| EP | 0 836 826 | 4/1998 |
| EP | 1 438 918 | 7/2004 |
| EP | 1 708 603 | 10/2006 |
| EP | 1 771 104 | 4/2007 |
| GB | 2474475 | 4/2011 |
| GB | 2495124 | 4/2013 |
| JP | 8-322768 | 12/1996 |
| JP | 2003-210369 | 7/2003 |
| KR | 10-0351843 | 9/2002 |
| WO | WO-2009/138811 | 11/2009 |

* cited by examiner

UPRIGHT VACUUM CLEANER

REFERENCE TO RELATED APPLICATIONS

This application claims the priority of United Kingdom Application No. 1515105.3, filed Aug. 25, 2015, the entire contents of which are incorporated herein by reference.

FIELD OF THE INVENTION

The present invention relates to upright vacuum cleaners.

BACKGROUND OF THE INVENTION

Upright cleaners typically have a wheeled head assembly, which carries a fixed cleaner head in plane-parallel contact with the floor surface. This head assembly is mounted on a reclining 'upright' body which carries a handle at its upper end. In the conventional floor-cleaning mode, a user reclines the 'upright' body until the handle is at a convenient height, and then uses the handle manually to push the cleaner across the floor, maintaining the cleaner head in plane parallel contact with the floor surface.

It is often desirable to vacuum-clean above the level of a floor. For example, it may be desirable to vacuum-clean shelving, stairs or the upper corners of a room. It is usually completely impractical to use the main cleaner head for this purpose: the cleaner will almost certainly be too heavy and cumbersome, and the cleaner head itself too large. Instead, many modern upright vacuum cleaners are provided with a suction wand which connects to the main separating apparatus onboard the vacuum cleaner via a flexible hose. This wand and hose assembly allows the upright vacuum cleaner to be operated, as required, in the manner of a cylinder (or "canister") vacuum cleaner—making "above-the-floor" cleaning much more practical.

SUMMARY OF THE INVENTION

Aspects of the present invention are concerned with upright vacuum cleaners in which the wand is stored onboard the vacuum cleaner when the wand is not in use, and seek to provide an improved arrangement for storing the wand.

According to aspects of the present invention there is provided an upright vacuum cleaner comprising a vac-motor for drawing dirty air in through a floor-engaging cleaner head on the vacuum cleaner, a separating apparatus for separating dirt from the dirty air, an elongate air duct for carrying air to or from the separating apparatus, and a suction wand which is stored on the vacuum cleaner and which can be connected to the separating apparatus via a hose as required to clean above the floor, wherein the external surface of the air duct defines an elongate recess for receiving the stored suction wand such that the air duct partly surrounds the stored wand.

In effect, the stored wand is nested in the elongate recess, advantageously providing a compact storage configuration.

The separating apparatus may be removably connected to the elongate air duct, although this is not essential. The external surface of the separating apparatus may define an elongate channel for receiving the elongate air duct such that the separating apparatus partly surrounds the elongate duct. Thus, the wand is nested in the elongate recess formed by the external surface of the air duct and the elongated air duct is in turn nested in elongate recess in the separating apparatus, making the storage configuration even more compact.

In a particularly compact configuration, the separating apparatus also partly surrounds the stored wand when the separating apparatus is connected to the elongate air duct.

The elongate air duct may form part of an upright chassis which runs up the rear of the vacuum cleaner, behind the separating apparatus. The elongate air duct itself may run centrally up the rear of the vacuum cleaner.

The upright chassis may support a switch assembly incorporating one or more power switches for operating the vacuum cleaner. The switch assembly may be located towards the upper end of the upright chassis, above the top of the separating apparatus.

The upright chassis may support a catch assembly for securing the separating apparatus on the vacuum cleaner. This catch assembly may be located towards the upper end of the upright chassis.

The separating apparatus may be any kind of separating apparatus, but is preferably a cyclonic separating apparatus, in which case the separating apparatus may comprise a dust collector for collecting dust ejected from one or more cyclone chambers, and the elongate channel may be formed in the wall of the dust collector.

The wand may be retractable into the hose for storage. In this arrangement, the elongate recess may be arranged to receive and partly surround both the stored suction wand and the hose.

BRIEF DESCRIPTION OF THE DRAWINGS

Embodiments of the invention will now be described with reference to the accompanying drawings, in which.

DETAILED DESCRIPTION OF THE INVENTION

Figure 1:
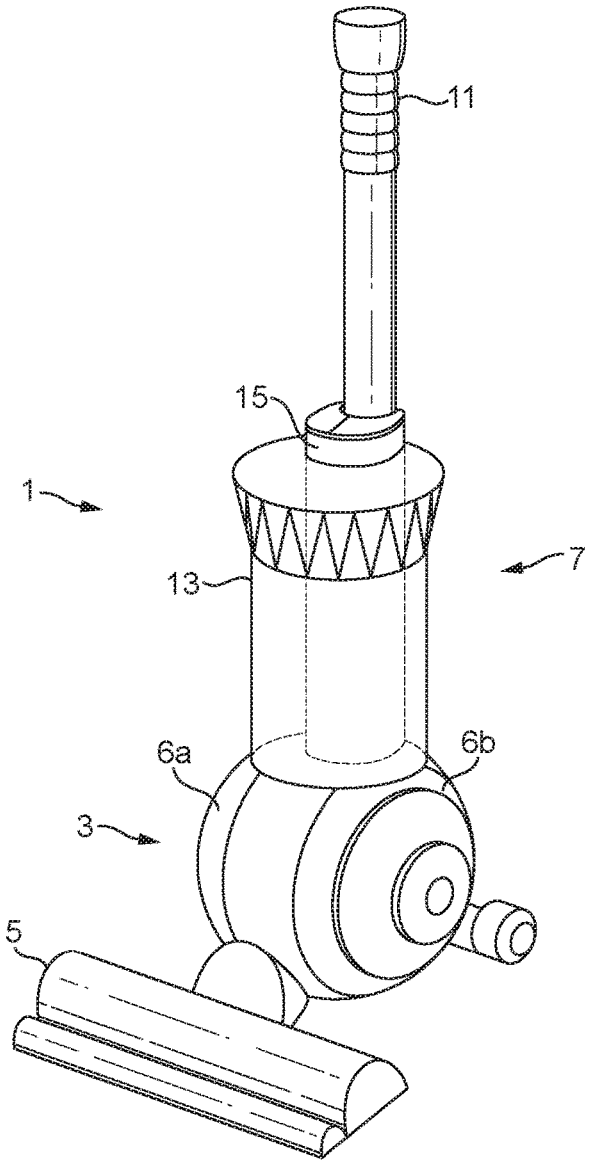
FIG. 1 is a perspective view of an upright vacuum cleaner according to the present invention.
Figure 2:
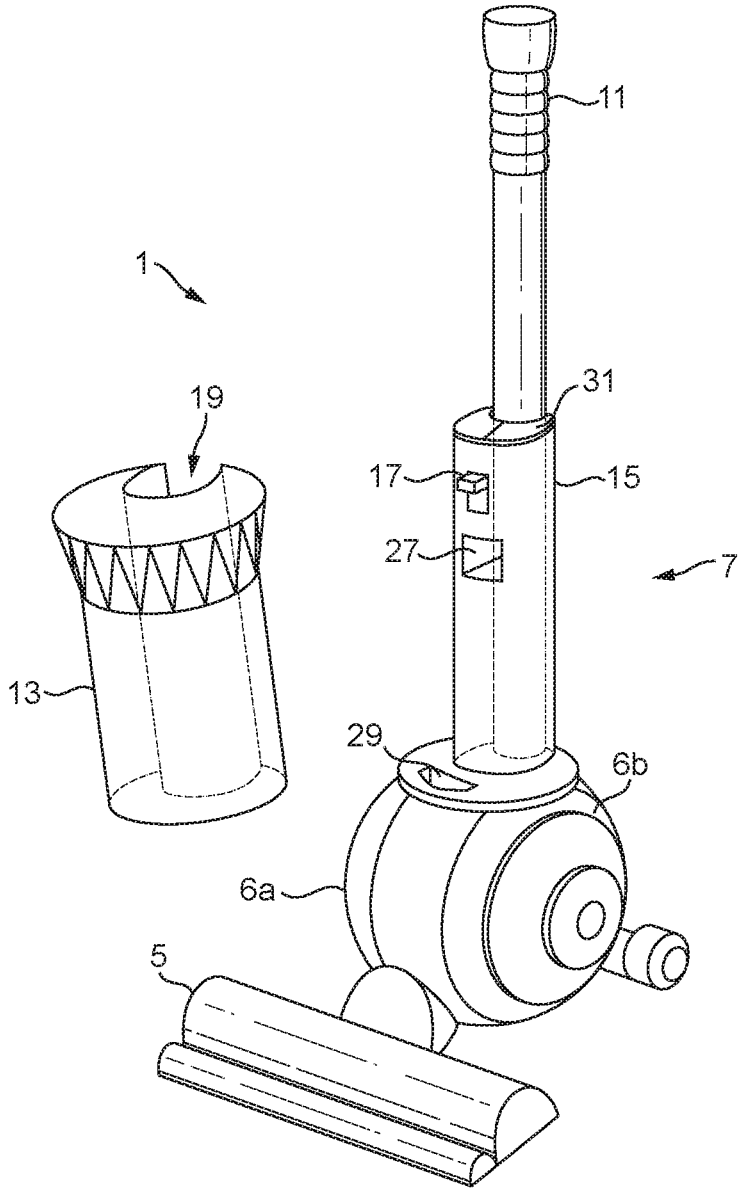
FIG. 2 is a perspective view of the upright vacuum cleaner in FIG. 1, with the separating apparatus removed from the upright chassis.

Referring now to FIG. 1, the upright vacuum cleaner 1 comprises a rolling head assembly 3, which includes a fixed cleaner head 5 and a pair of large dome-shaped wheels 6*a*, 6*b*, and an 'upright' body 7 which can be reclined relative to the head assembly 3 and which includes a handle 11 for manouevring the cleaner 1 across the floor. In use, a user grasps the handle 11 and reclines the upright body 7 until the handle 11 is disposed at a convenient height for the user; the user can then roll the vacuum cleaner 1 across the floor using the handle 11 in order to pick up dust and other debris on the floor. This general floor-cleaning mode of operation for an upright vacuum cleaner is illustrated in, for example, GB2474475A.

The dust and debris is drawn in through a downward-facing suction inlet on the cleaner head 5 by a motor-driven fan housed between the dome-shaped wheels 6*a*, 6*b*. From here, the dirt-laden air stream is ducted in conventional manner under the fan-generated suction pressure to a cyclonic separating apparatus 13, where dirt is separated from the air before the relatively clean air is then expelled back to the atmosphere.

The separating apparatus 13 is removably mounted on an upright chassis 15 which runs centrally up the rear of the vacuum cleaner 1. The separating apparatus 13 mounts on to the front of this upright chassis 15, such that the upright chassis 15 sits behind the separating apparatus 13. A catch 17 is provided near the top end of the upright chassis 15 which secures the separating apparatus in place on the upright chassis 15 and which can be operated manually to release the separating apparatus from the upright chassis 15. The catch 17 is represented only schematically in the Figures. In practice, any suitable conventional catch may be used. One possible design of catch 17 is described in EP1771104B, for example.

The external surface of the separating apparatus 13 defines an elongate channel 19 which runs up the rear of the separating apparatus 13. When the separating apparatus 13 is mounted in position on the upright chassis 15, the upright chassis 15 is nested within this elongate channel 19—see FIG. 1. This provides a compact arrangement.

Figure 4:
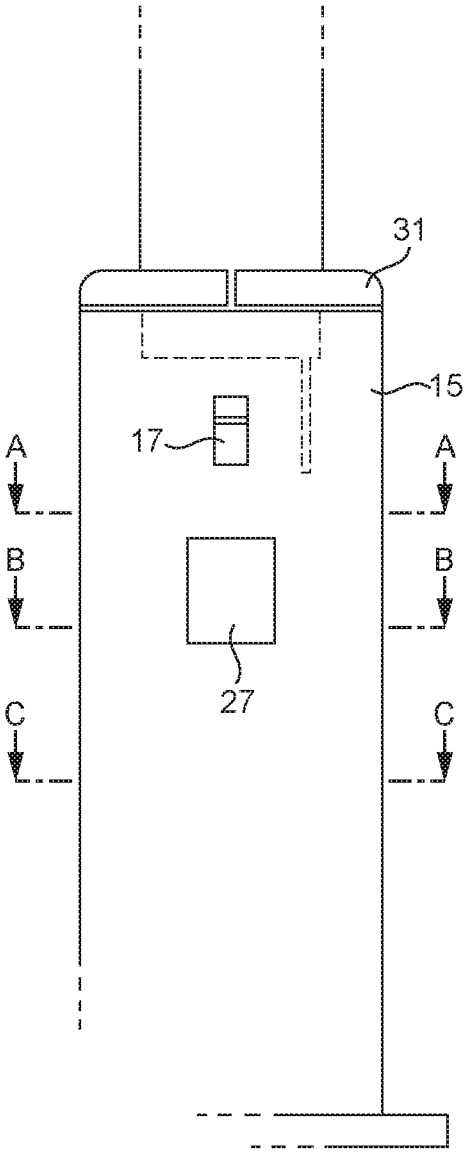
FIG. 4 is a front view of the upright chassis.
Figure 5:
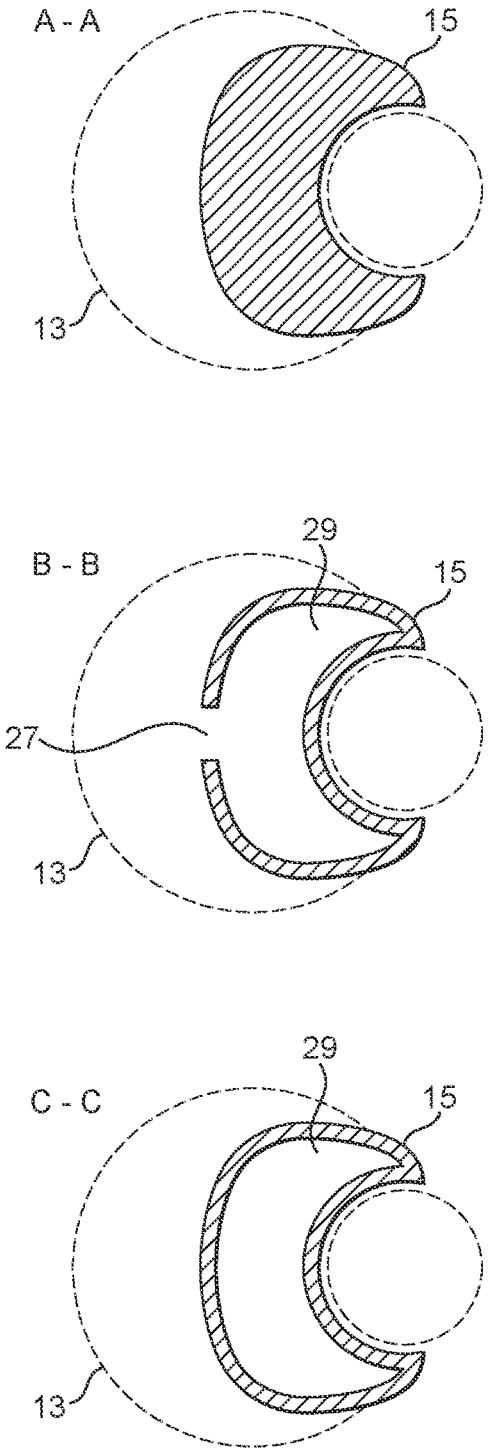
FIG. 5 is a series of sectional views showing three different sections through the upright chassis.

The upright chassis forms an air duct 29 which runs centrally up the rear of the cleaner 1—see FIGS. 4 and 5.

A lower end of the air duct 29 connects to the cleaner head 5 via a flexible hose (not shown) routed between the dome-shaped wheels 6*a*, 6*b*. An upper end of the air duct 29 connects to an inlet 25 on the separating apparatus 13 (see FIG. 3) via an opening 27 in the front exterior wall of the upright chassis 15, which opening 27 is arranged for sealing connection to an inlet 25 on the separating apparatus 13—see FIG. 3. The air duct 29 thus carries the dirty air from the cleaner head 5 to the separating apparatus 13.

Figure 3:
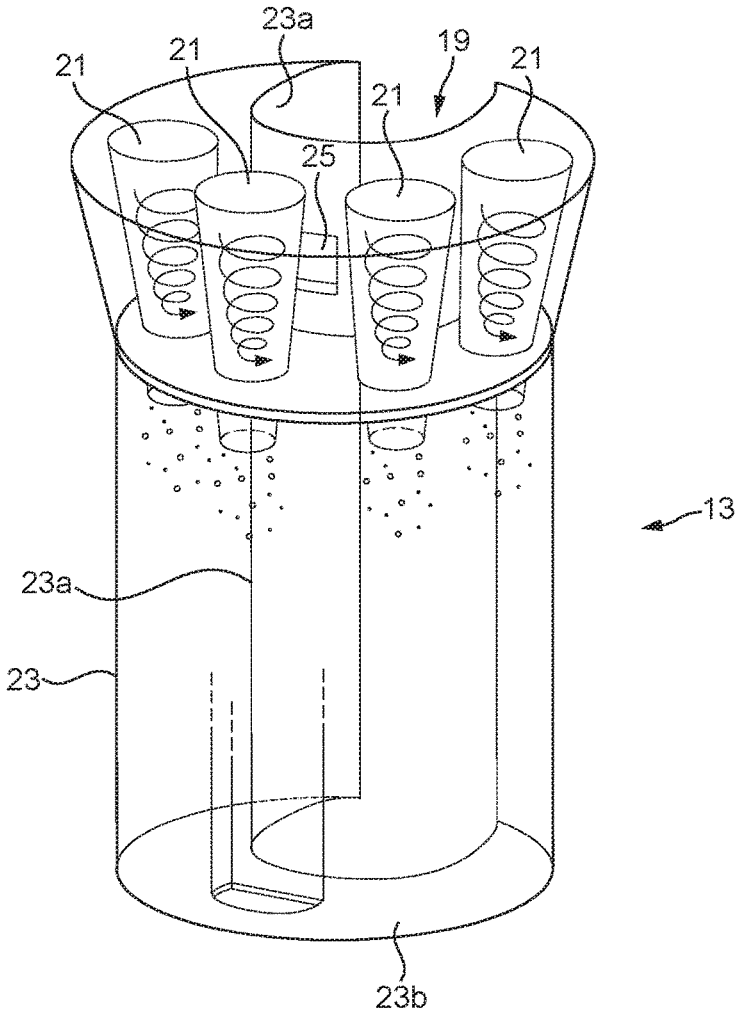
FIG. 3 is a perspective view of the separating apparatus.

Inside the separating apparatus 13, a plurality of cyclone chambers 21 is provided at the top of the separating apparatus 13—see FIG. 3. The cyclone chambers 21 are arranged around the top of the elongate channel 19 so that the cyclone chambers 21 in effect partly surround the top of the elongate channel 19. Four cyclone chambers 21 are shown in FIG. 3, but in practice the number may vary.

A dust collector 23 is located below the cyclone chambers 21. The dust collector 23 is generally horseshoe-shaped in cross-section, and partly surrounds the entire lower section of the elongate channel 19. A wall 23*a* of the dust collector 23 forms part of the elongate channel 19.

In use, the dirty air enters the separating apparatus 13 through the inlet 25 in the wall of the elongate channel 19 at the rear of the separating apparatus 13. From here, the dirty air is ducted to respective tangential inlets on the cyclone chambers 21 in parallel (the physical ducting and tangential inlets have been omitted for clarity) and cyclonic dust separation takes place inside each of the cyclone chambers 21 in conventional manner. The air exits through the top of the cyclone chambers 21 and is then ducted down through the dust collector 23 to an outlet 27 in the base 23*b* of the dust collector 23 which in turn connects to a vac-motor inlet 29 on the upright chassis (the air outlets from the cyclone chambers and the physical ducting to the outlet 27 have again been omitted for clarity).

The separated dirt exits through the open bottom ends of the cyclone chambers 21 and is deposited in the dust collector 23. Conventional provision may be made for periodic emptying of the dust collector, as required, for example via a manually operated hatch in the base of the dust collector.

The separating apparatus 13 is a single-stage cyclonic separating apparatus. Multi-stage cyclonic separation may be provided as an alternative to single-stage cyclonic separation. For example, the four cyclone chambers in FIG. 3 may be arranged into two stages connected in series, each stage comprising two of the cyclone chambers 21 connected in parallel (in practice there may be many more than two cyclone chambers in each stage in order to reduce the pressure drop across each stage). In this arrangement, two separate dust collectors would need to be provided—one for each stage. This may be achieved simply by partitioning the dust collector 23 accordingly, for example.

A switch assembly is provided at the top of the upright chassis which incorporates a manually operated ON/OFF power switch 31. Additional power switches may be provided, for example to operate a motor-driven brush bar inside the cleaner head 5.

Figure 6:
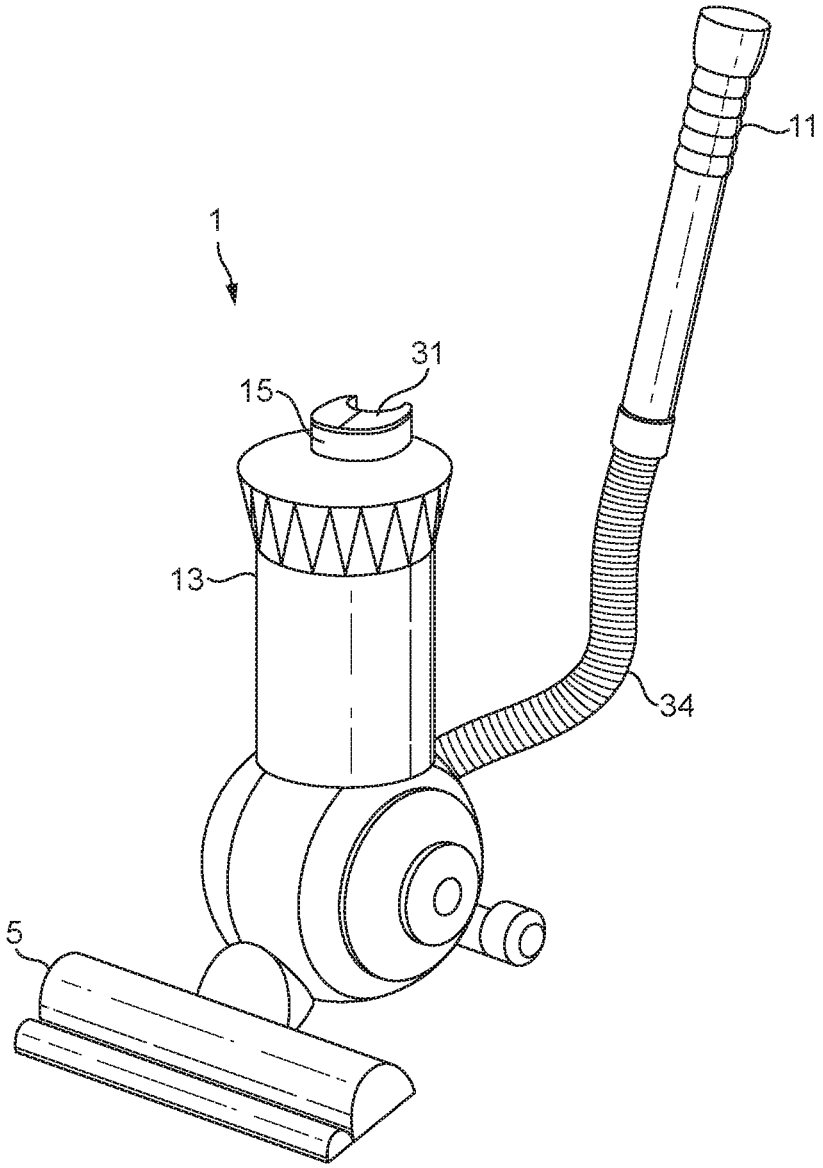
FIG. 6 is a perspective view of the vacuum cleaner with the suction wand removed for use.

Referring now to FIG. 6, the vacuum cleaner 1 additionally comprises a suction wand 33 which can be used to perform above-the-floor cleaning tasks such as cleaning curtains or the upper corners of a room.

The removable wand 33 is connected to the separating apparatus 13 via a flexible hose 34. A so-called changeover valve—not shown—is used selectively to connect the separating apparatus 13 either to the cleaner head 5 or, alternatively, to the wand 33 when the wand 33 is being used. Any conventional changeover valve arrangement may be used.

The handle 11 is supported on the suction wand 33—and so comes away with the suction wand 33 when the wand is removed from the upright body 7—but to use the wand a user actually grasps the opposite end of the wand 33, adjacent the hose 35. This allows the user easily to manipulate the wand 33 for cleaning.

The wand 33 is stored in a generally vertical orientation onboard the vacuum cleaner 1 when it is not in use. An elongate recess 35 is formed by the rear external wall of the air duct 29. The stored wand 33 sits in this recess 35 so that the wand 33 is in effect nested in the recess 35. This provides a compact storage configuration.

When the wand 33 is in its stored position, nested in the recess 35, and the separating apparatus 13 is mounted on the upright chassis 7 so that it is connected to the air duct 29, the separating apparatus 13 partly surrounds both the upright chassis and the wand—see FIG. 5 which illustrates the separating apparatus 13 and wand 33 in dotted outline. This provides a particularly compact configuration.

In an alternative embodiment (not illustrated), the wand 33 is retractable inside the hose 34 for storage on board the vacuum cleaner 1. In this arrangement, both the wand 33 and hose 34 are stored in a generally vertical orientation onboard the vacuum cleaner 1, nested within the elongate recess 35. The elongate recess 35 thus partly surrounds both the stored wand 33 and the hose 34.

The invention claimed is:

1. An upright vacuum cleaner comprising:

a vac-motor for drawing dirty air in through a floor-engaging cleaner head on the vacuum cleaner;

a separating apparatus for separating dirt from the dirty air;

an elongate air duct for carrying air to or from the separating apparatus; and a suction wand which is stored on the vacuum cleaner and which can be connected to the separating apparatus via a hose as required to clean above the floor, wherein the external surface of the air duct defines an elongate recess for receiving the stored suction wand such that the air duct partly surrounds the stored wand.

2. The upright vacuum cleaner of claim 1, wherein the separating apparatus is removably connected to the elongate duct, the external surface of the separating apparatus defining an elongate channel for receiving the elongate duct such that the separating apparatus partly surrounds the elongate duct.

3. The upright vacuum cleaner of claim 2, wherein, when the separating apparatus is connected to the elongate air duct, the separating apparatus also partly surrounds the stored wand.

4. The upright vacuum cleaner of claim 1, wherein the elongate air duct forms part of an upright chassis which runs up the rear of the vacuum cleaner behind the separating apparatus.

5. The upright vacuum cleaner of claim 4, wherein the elongate air duct runs centrally up the rear of the vacuum cleaner.

6. The upright vacuum cleaner of claim 4, wherein the upright chassis comprises a switch assembly incorporating one or more power switches for operating the vacuum cleaner.

7. The upright vacuum cleaner of claim 6, wherein the switch assembly is located towards an upper end of the upright chassis, above the top of the separating apparatus.

8. The upright vacuum cleaner of claim 4, wherein the upright chassis comprises a catch assembly for securing the separating apparatus on the vacuum cleaner.

9. The upright vacuum cleaner of claim 8, wherein the catch assembly is located towards an upper end of the upright chassis.

10. The upright vacuum cleaner of claim 1, wherein the separating apparatus is a cyclonic separating apparatus.

11. The upright vacuum cleaner of claim 10, wherein an external surface of the separating apparatus defines an elongate channel for receiving the elongate duct such that the separating apparatus partly surrounds the elongate duct, and the elongate channel is formed in the wall of a dust collector forming part of the cyclonic separating apparatus.

12. The upright vacuum cleaner of claim 1, wherein the wand is retractable inside the hose for storage.

13. The upright vacuum cleaner of claim 12, wherein the elongate recess is arranged to receive and partly surround both the stored suction wand and the hose.

* * * * *